US006206763B1

(12) United States Patent
Mackall

(10) Patent No.: US 6,206,763 B1
(45) Date of Patent: Mar. 27, 2001

(54) DEBURRING MACHINE

(75) Inventor: Allen E. Mackall, Negley, OH (US)

(73) Assignee: Ohio Custom Machinery, Inc., Lisbon, OH (US)

( * ) Notice: Subject to any disclaimer, the term of this patent is extended or adjusted under 35 U.S.C. 154(b) by 0 days.

(21) Appl. No.: 09/274,695

(22) Filed: Mar. 23, 1999

Related U.S. Application Data

(60) Provisional application No. 60/118,016, filed on Feb. 1, 1999.

(51) Int. Cl.[7] ..... B24B 7/30

(52) U.S. Cl. ..... 451/51; 451/190; 451/194; 451/130; 451/260; 451/299; 451/302; 451/336; 451/337; 198/626.5; 198/803.11

(58) Field of Search ..... 451/51, 190, 194, 451/130, 260–261, 299, 302, 336, 337; 198/626.5, 817, 867.08, 803.11; 221/253, 236, 237, 266

(56) References Cited

U.S. PATENT DOCUMENTS

| | | | | |
|---|---|---|---|---|
| 2,231,921 | | 2/1941 | Kitlar et al. . | |
| 2,387,446 | | 10/1945 | Herz . | |
| 3,337,024 | | 8/1967 | Gilewski . | |
| 3,545,589 | * | 12/1970 | Keller | 198/26 |
| 3,746,212 | * | 7/1973 | Anderheggen et al. | 221/253 |
| 4,042,098 | * | 8/1977 | D'Agnolo et al. | 128/393 |
| 4,100,950 | * | 7/1978 | Stearns | 144/242 |
| 4,240,231 | | 12/1980 | Day . | |
| 4,798,281 | * | 1/1989 | Egger | 198/626.5 |
| 5,129,122 | * | 7/1992 | Shafer et al. | 451/51 |

* cited by examiner

*Primary Examiner*—Joseph J. Hail, III
(74) *Attorney, Agent, or Firm*—Sand & Sebolt

(57) ABSTRACT

A brush deburring machine includes upper and lower synchronized dogged conveyors that translate workpieces between a pair of cylindrical wire brushes to remove burrs from the ends of the workpieces. A first support surface is defined on each of the dogs of the upper conveyor, and a second support surface is defined on each of the dogs of the lower conveyor. Workpieces are retained between the first and second support surfaces to prevent the workpieces from becoming unstable and shifting diagonally between the wire brushes, yet are permitted to rotate with respect to the first and second support surfaces to cause the entire circumference of the ends of the workpieces to be deburred. A keyless bushing permits the upper conveyor to be infinitely adjustable between a minimum position and a maximum position with respect to the lower conveyor without interfering with the synchronization between the upper and lower conveyor, thus permitting the deburring machine to remove burrs from workpieces having different outer diameters. The workpieces are translated between wire brushes contained in a fixed head and an adjustable head, the adjustable head being adjustable to permit the deburring machine to remove the burrs from workpieces of different lengths.

34 Claims, 12 Drawing Sheets

DEBURRING MACHINE

CROSS REFERENCE TO RELATED APPLICATION

The present application is a utility application claiming priority from U.S. Provisional Application Serial No. 60/118,016, filed Feb. 1, 1999, the disclosures of which are incorporated herein by reference.

BACKGROUND OF THE INVENTION

1. Technical Field

The invention relates generally to finishing machinery and, more particularly, to a machine for removing burrs from the ends of tubing sections. Specifically, the invention relates to a deburring machine having two synchronized dogged conveyors, one conveyor being adjustable, that rotatably retain a length of tubing between the dogs while the dogs are translated past a rotating brush that removes burrs from the ends of the tube.

2. Background Information

Short lengths of tubing are used in myriad applications in the automotive field as well as other fields. Short lengths of tubing are typically cut from longer lengths of tubing stock, with the cutting operation typically leaving a number of burrs on the cut edge. The burrs generally must be removed prior to using the cut piece of tubing.

Numerous methods exist for removing the burrs from the tubing pieces, the most typical involving the use of a wire brush applied to the ends to remove the burrs. Numerous such devices are well known and understood in the relevant art, the most popular among them being a machine that employs a single dogged conveyor to drive the lengths of tubing in a direction transverse to their longitudinal axis between a pair of opposed drum-shaped wire brushes rotating about substantially parallel axes, the rotating brushes removing the burrs from the length of tubing as it is passed therebetween. With such machinery, it is desired that the length of tubing be permitted to rotate about its own axis as it passes between the wire brushes to allow the entire circumference of both ends to be properly deburred.

Such rotation of the length of tubing during deburring occurs as the dogged conveyor rolls the length of tubing along a support rail. The length of tubing is thus preferably permitted to rotate about its own axis as it is driven between the brushes by the dogged conveyor and thus should not be clamped or fixedly attached to the conveyor.

While such machines have achieved limited success for their intended purpose, such machines have not, however, been without limitation. One problem inherent in such machines is that the minimum length of tubing that can be successfully deburred is on the order of about six inches. Inasmuch as the piece of tubing is not clamped to the conveyor dogs, pieces of tubing less than six inches in length have a tendency to become unstable and shift diagonally in the wire brush section of the machine, often causing the machine to become jammed or at best resulting in a poorly deburred length of tubing. Such instability and diagonal shifting results primarily because the section of tubing is lightweight and is not clamped or fixedly attached to the dogged conveyor but is free to rotate.

It is thus desired to provide a deburring machine that permits lengths of tubing under six inches in length to be properly deburred by minimizing the potential for the length of tubing to become unstable and to shift diagonally in the wire brush section of the machine. Such a machine would preferably include a pair of support surfaces on a pair of synchronized dogged conveyors that are configured to retain the length of tubing therebetween yet permit the length of tubing to rotate axially with respect to the support surfaces to permit the entire circumference of the ends of the length of tubing to be properly deburred.

SUMMARY OF THE INVENTION

In view of the foregoing, an objective of the invention is to provide a deburring machine that retains a section of tubing between a pair of support surfaces as the length of tubing is passed between a pair of drum-shaped wire brushes yet permits the length of tubing to rotate freely with respect to the support surfaces.

Another objective of the invention is to provide a deburring machine that contains two dogged conveyors for retaining a length of tubing as the tubing is driven between a pair of wire brushes.

Another objective of the invention is to provide a deburring machine having two dogged conveyors, at least one of which is adjustable, to permit the deburring machine to deburr lengths of tubing having different outer diameters.

Another objective of the invention is to provide a deburring machine that can deburr the ends of various lengths of tubing.

Another objective of the invention is to provide a deburring machine that can deburr the ends of lengths of tubing shorter than six inches.

Another objective of the invention is to provide a deburring machine containing two dogged conveyors, the two conveyors being operationally synchronized.

Another objective of the invention is to provide a deburring machine having two synchronized dogged conveyors, one conveyor being adjustable with respect to the other without interfering with the synchronization therebetween.

Another objective of the invention is to provide a deburring machine having a pair of support surfaces that permit a length of tubing to roll along a fixed support rail.

Another objective of the invention is to provide a deburring machine having a pair of support surfaces on separate conveyors, the support surfaces being in register with one another.

Another objective of the invention is to provide a deburring machine having a pair of dogged conveyors that provide a pair of support surfaces that retain a length of tubing therebetween, yet permit the length of tubing to rotate axially with respect to the support surfaces.

These and other objectives and advantages of the invention are obtained from the deburring machine of the present invention, the general nature of which can be stated as including a frame, a first support surface and a second support surface mounted on the frame, a brush system, the first and second support surfaces translatable with respect to the brush system, and the first and second support surfaces configured to retain the workpiece therebetween, the workpiece being free to rotate with respect to the first and second support surfaces as the workpiece operationally interacts with the brush system.

Other objective and advantages are obtained from the method for removing burrs from a workpiece, the general nature of which can be stated as including the steps of translating the workpiece with a translation system through a brush system where brushes contact both ends of the workpiece, retaining the workpiece between first and second support surfaces defined on the translation system, and rotating the workpiece with respect to the first and second support surfaces.

Still other objective and advantages are obtained from the method for setting up a deburring machine to translate a workpiece in a translation direction, the deburring machine having a frame, a translation system formed on the frame, and a first support surface and a second support surface defined on the translation system, the workpiece having a length and an outer diameter, the general nature of which can be stated as including the step of adjusting one of the first and second support surfaces along the translation direction with respect to the other of the first and second support surfaces according to the outer diameter of the workpiece.

Other objectives and advantages are obtained from the improvement of the present invention, the general nature of which can be stated as relating to a deburring machine for removing burrs from a workpiece, the machine being of the type having a frame, a first dogged conveyor translatably mounted on the frame, the first dogged conveyor having at least a first dog, the at least first dog adapted to translate a workpiece past a brush system disposed adjacent the first dogged conveyor, with the general nature of the improvement being stated as including a second dogged conveyor translatably mounted on the frame, at least a first dog formed on the second dogged conveyor, and the workpiece being rollably retained between the at least first dog formed on the first dogged conveyor and the at least first dog formed on the second dogged conveyor.

BRIEF DESCRIPTION OF THE DRAWINGS

The preferred embodiment of the invention, illustrative of the best mode in which applicant contemplated applying the principles of the invention, is set forth in the following description and is shown in the drawings and is particularly and distinctly pointed out and set forth in the appended Claims.

Similar numerals refer to similar parts throughout the specification.

DESCRIPTION OF THE PREFERRED EMBODIMENT

Figure 1:
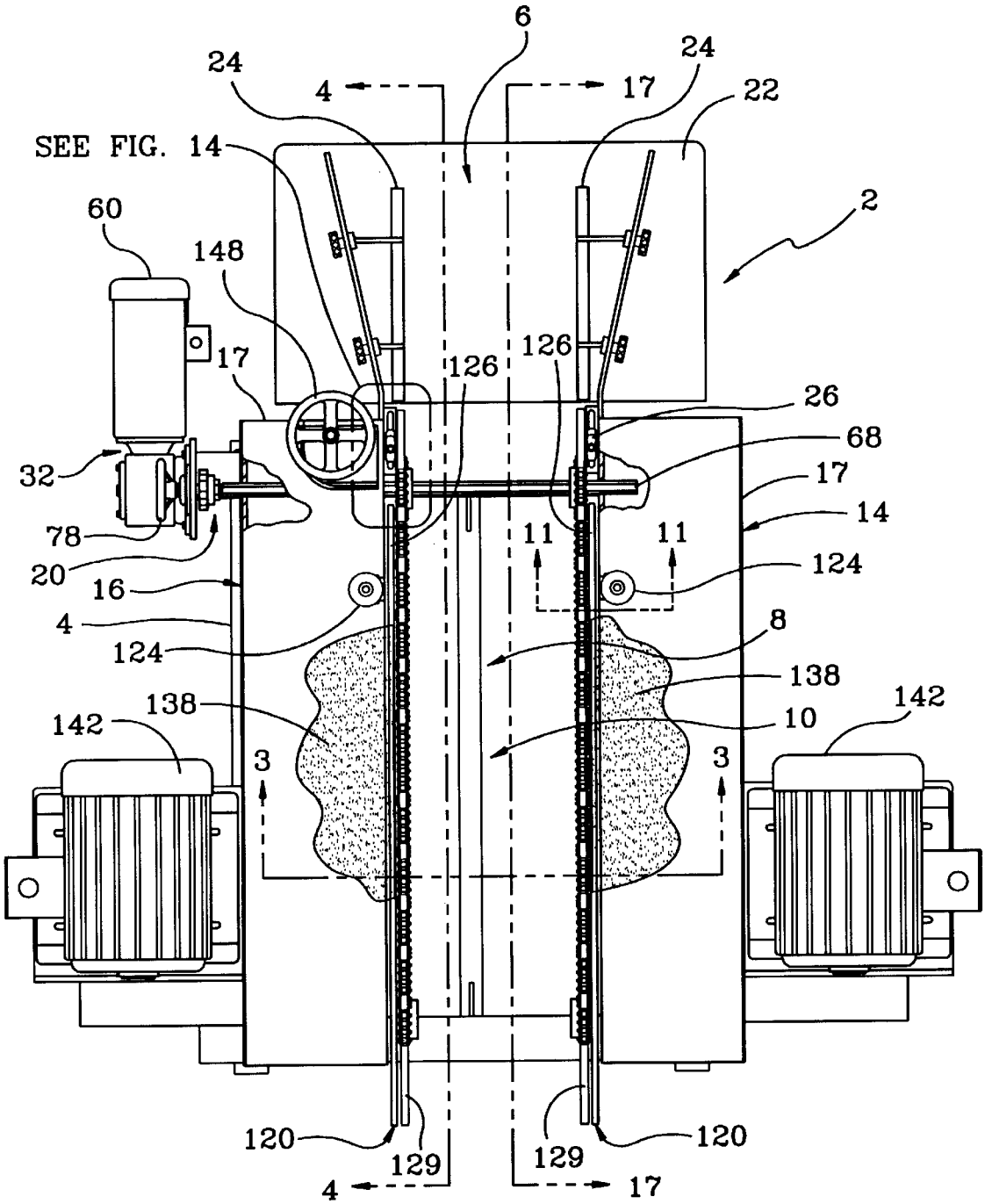
FIG. 1 is a top plan view of the deburring machine of the present invention.

The deburring machine of the present invention is indicated generally at the numeral 2 in the accompanying drawings. Deburring machine 2 includes a frame 4 with a feed system 6, a translation system 8, and a brush system 10 attached to frame 4. Deburring machine 2 removes burrs from the ends of a workpiece 12 with brush system 10 as workpiece 12 is translated through brush system 10 by translation system 8. Workpiece 12 is initially delivered to translation system 8 from feed system 6.

Figure 4:
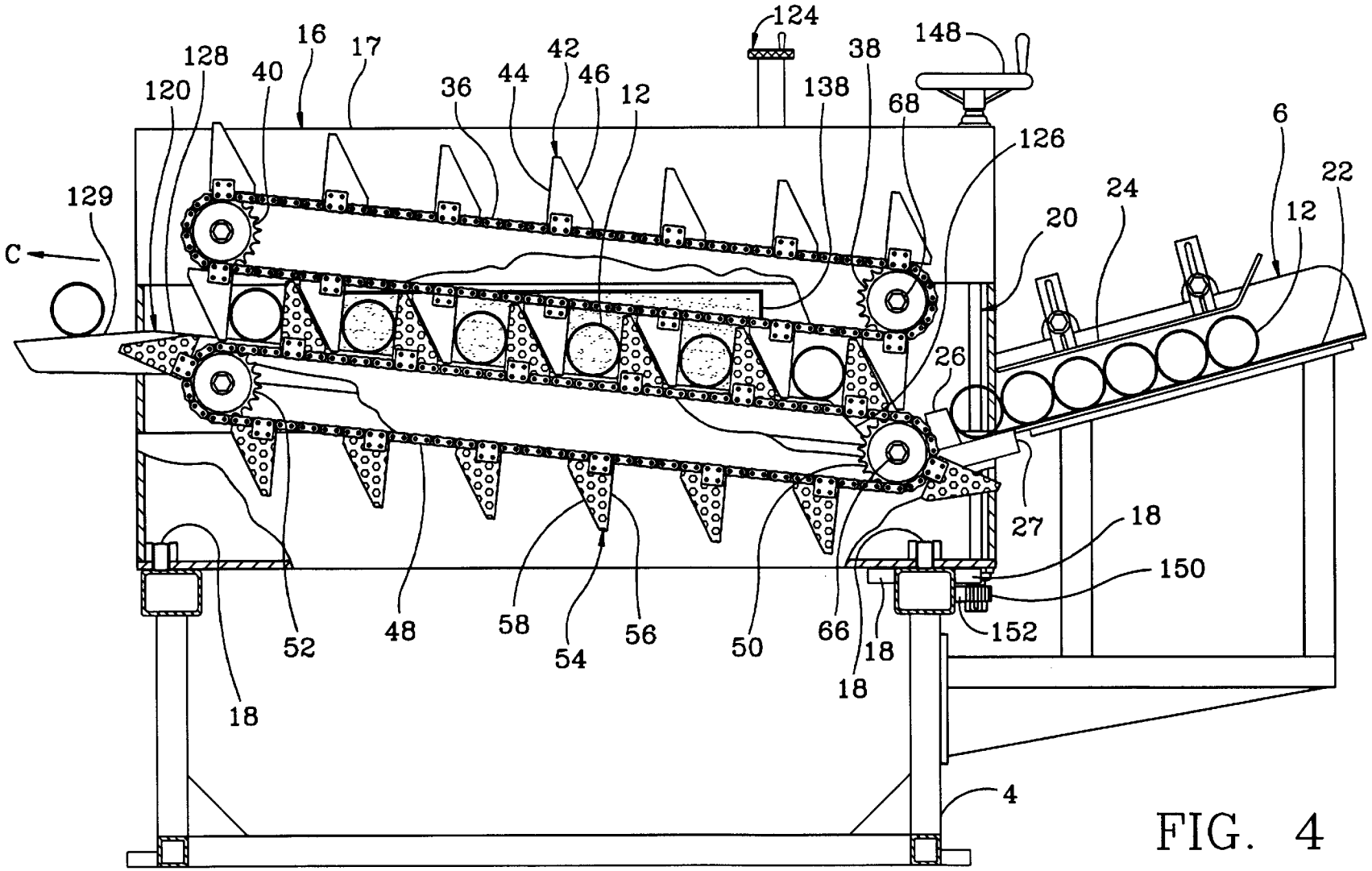
FIG. 4 is a sectional view as taken along line 4—4 of FIG. 1.
Figure 5:
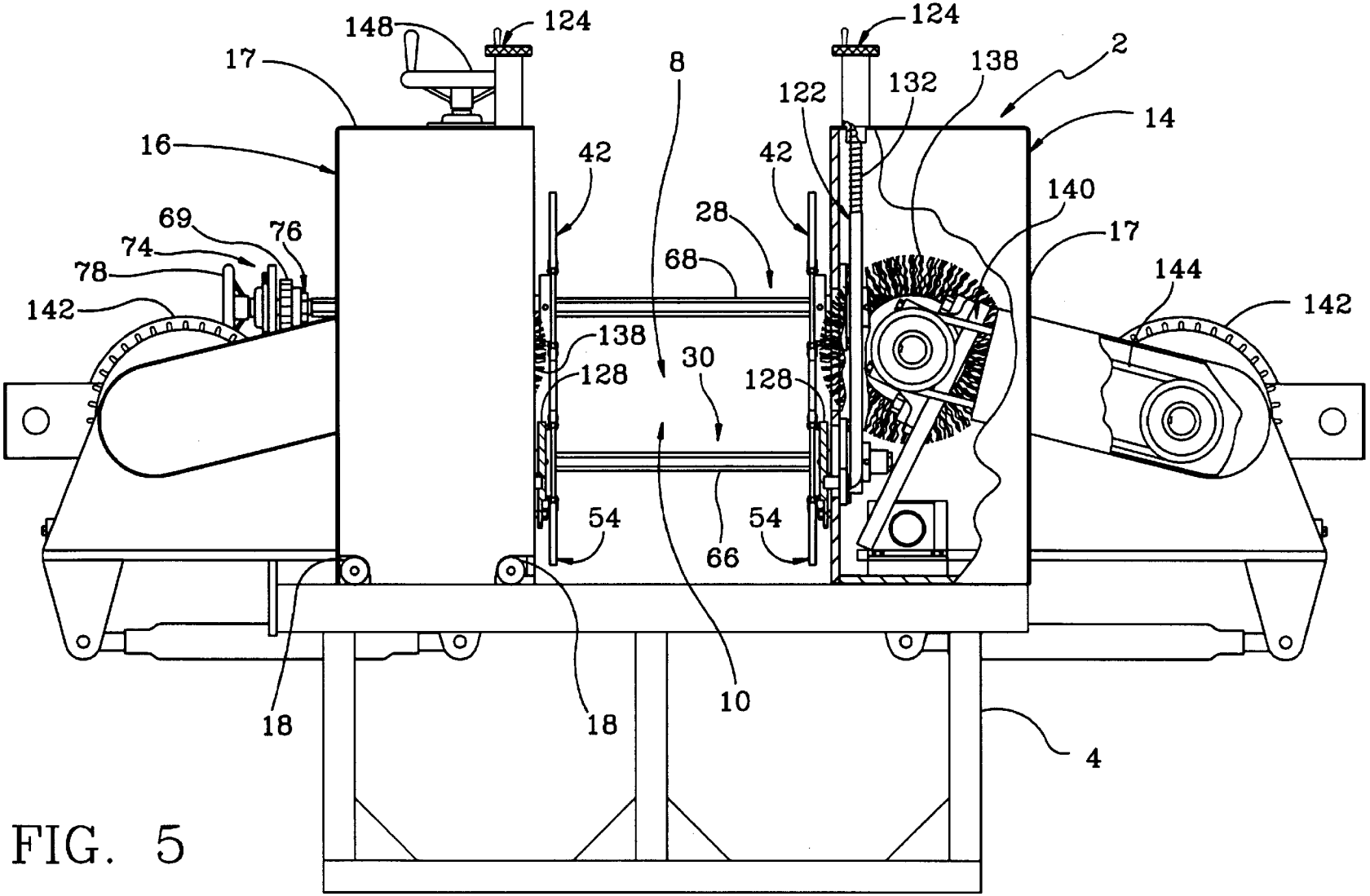
FIG. 5 is a front elevational view of the present invention shown partially cut away.
Figure 12:
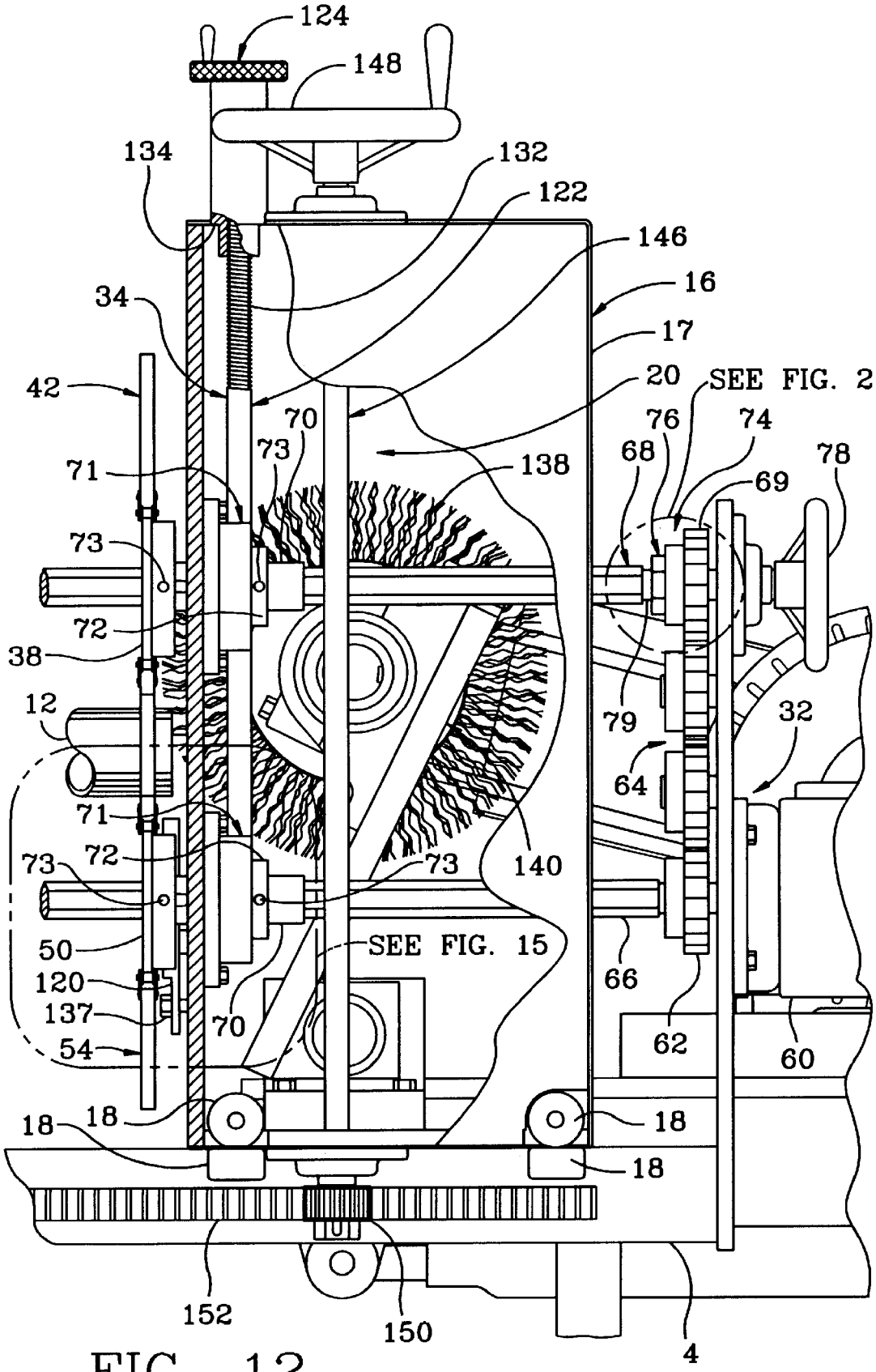
FIG. 12 is an enlarged view of the portion of FIG. 6 surrounded by phantom lines.
Figure 13:
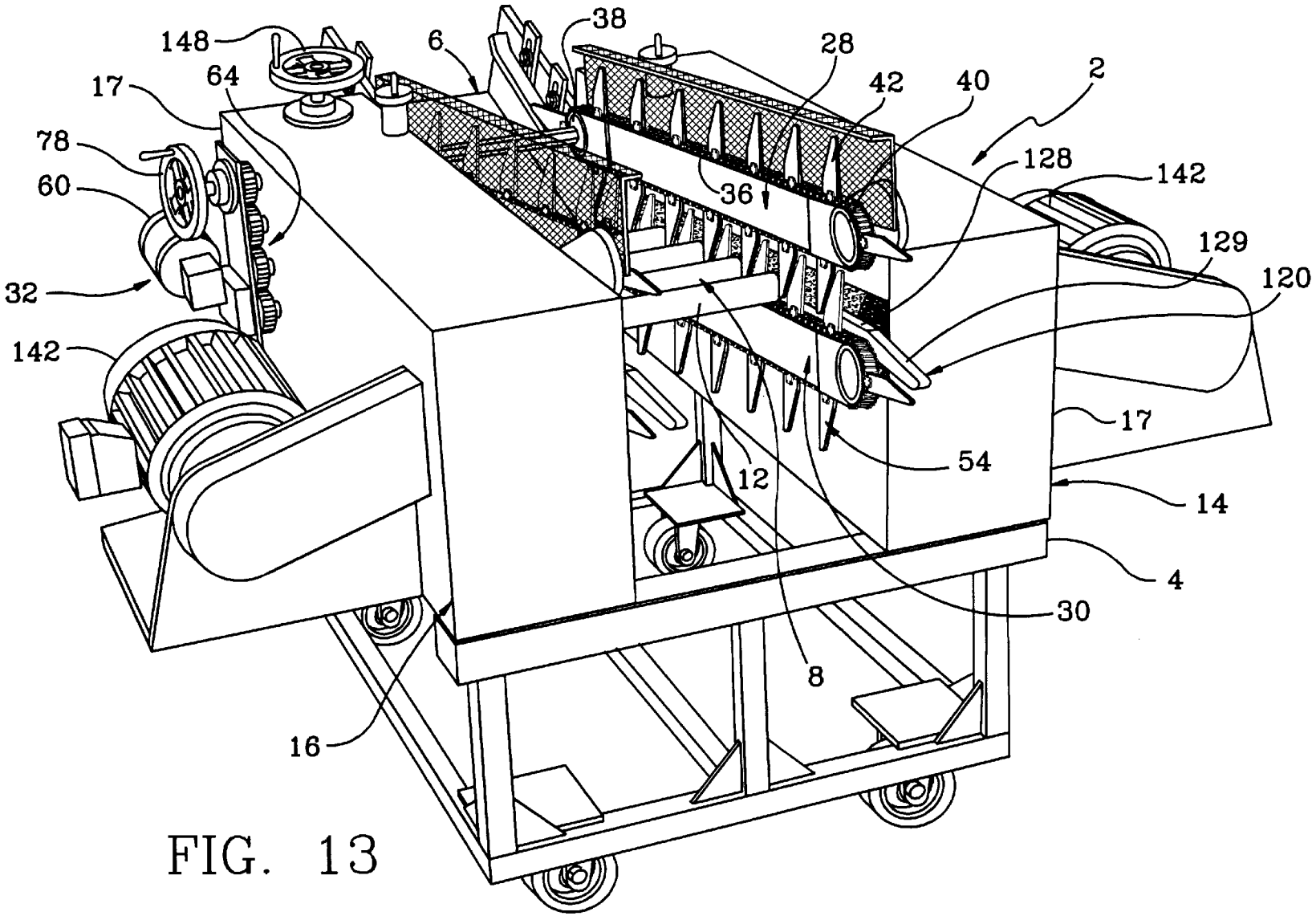
FIG. 13 is a perspective view of the present invention.

As is best shown in FIG. 1, translation system 8, brush system 10, and a portion of feed system 6 are arranged on deburring machine 2 in a configuration that provides a fixed head 14 and an adjustable head 16. Both fixed and adjustable heads 14 and 16 each include a housing 17, as will be set forth more fully below. Fixed head 14 is fixedly attached to frame 4. Adjustable head 16 is adjustably mounted to frame 4 and slides relative thereto on a plurality of rollers 18 (FIG. 4). As will be set forth more fully below, and in accordance with the features of the present invention, the transverse position of adjustable head 16 can be adjusted with a length adjustment assembly 20 (FIG. 12).

Figure 7:
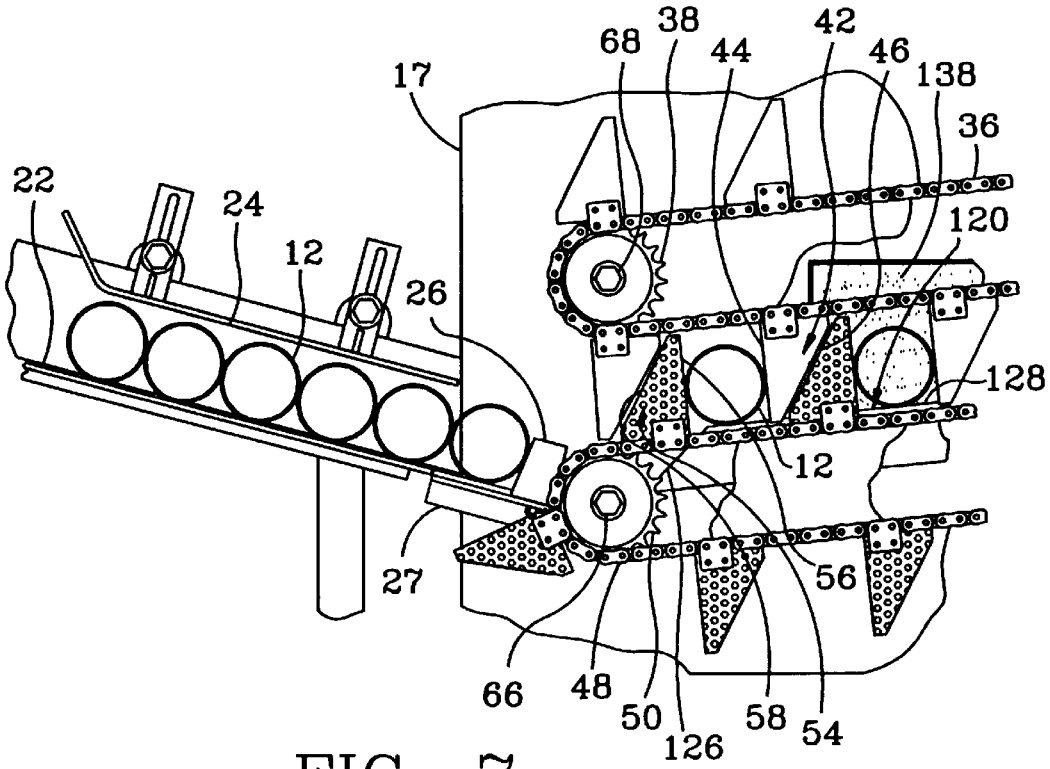
FIG. 7 is an enlarged view of the leftmost portion of FIG. 17 surrounded by phantom lines.
Figure 8:
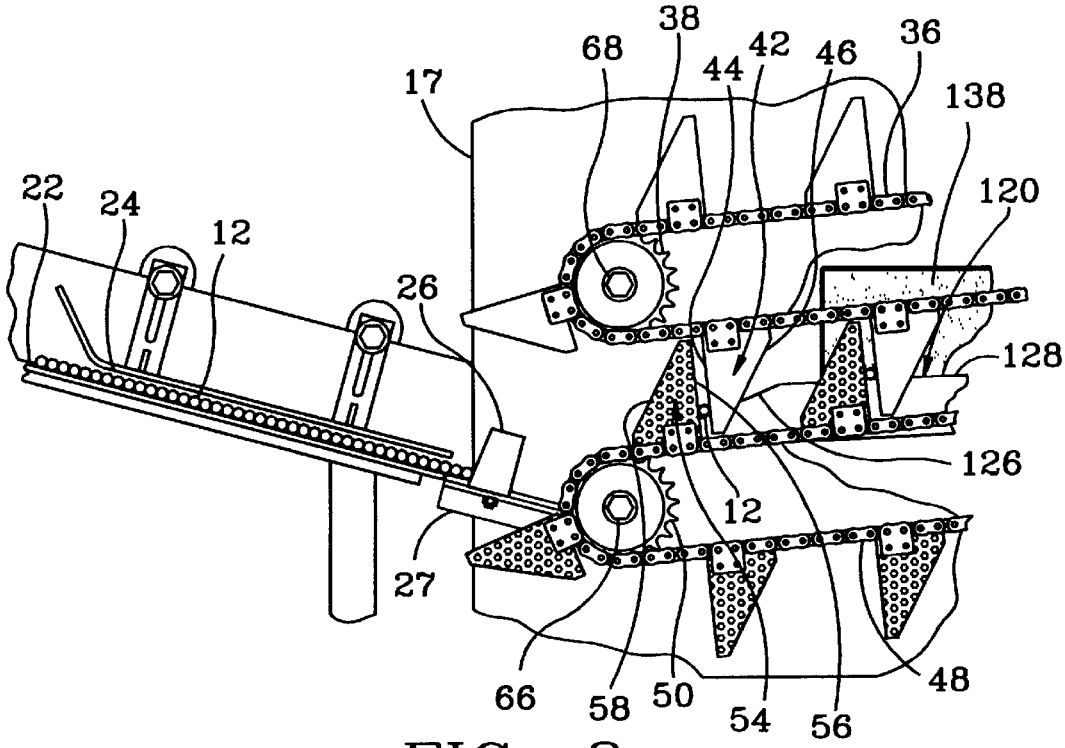
FIG. 8 is a view similar to FIG. 7 showing the present invention operating on workpieces of a smaller outer diameter than those shown in FIG. 7.
Figure 9:
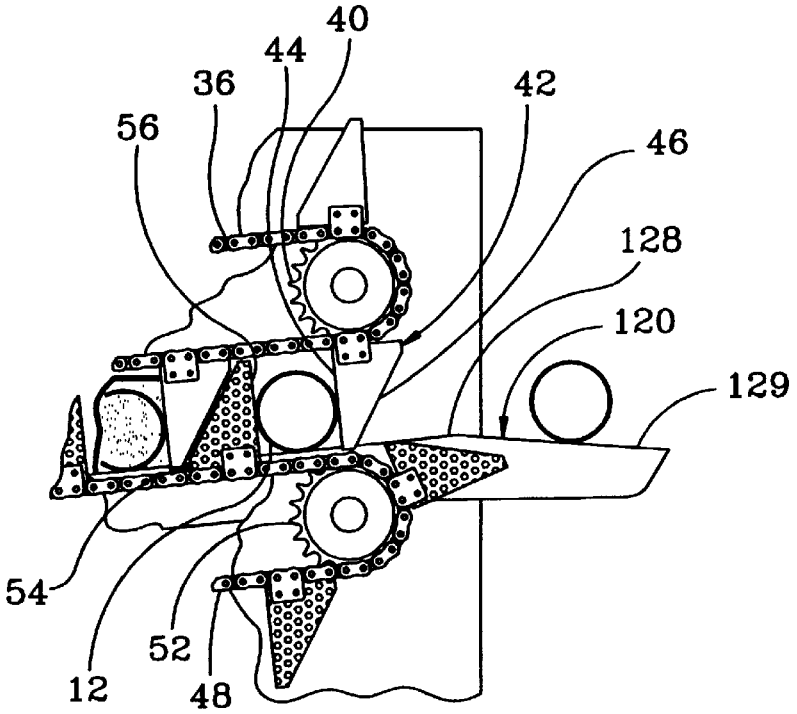
FIG. 9 is an enlarged view of the rightmost portion of FIG. 17 surrounded by phantom lines.
Figure 10:
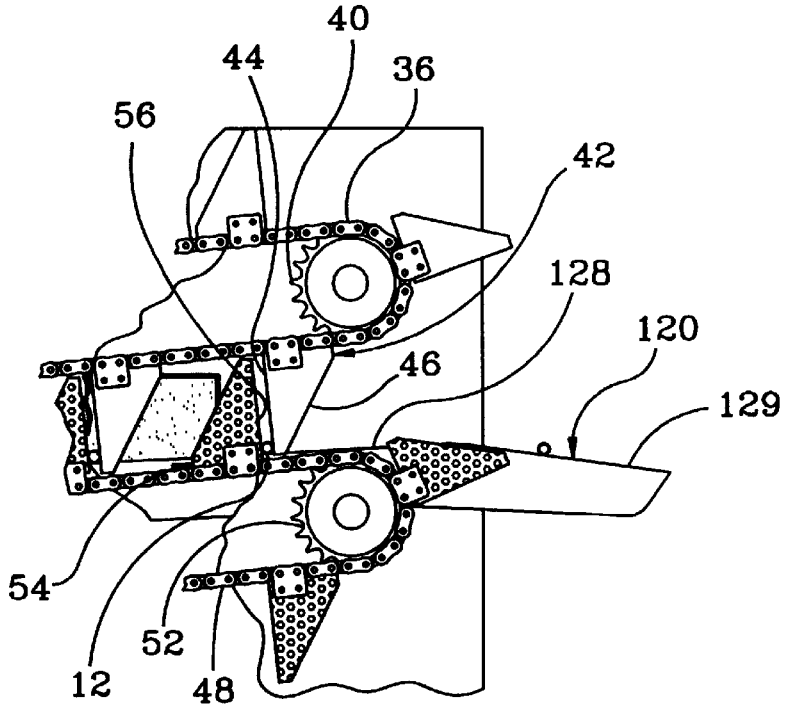
FIG. 10 is a view similar to FIG. 9 showing the present invention operating on workpieces of a smaller outer diameter than those shown in FIG. 9.

Feed system 6 includes an angled delivery plate 22, a pair of guide plates 24, and a pair of stopping blocks 26. As is best shown in FIGS. 7 and 8, delivery plate 22 is of sufficient size to contain a suitable number of workpieces 12 and is angled to delivery them to translation system 8. Guide plates 24 are relatively narrow guide strips that are disposed parallel to and spaced from delivery plate 22. Guide plates 24 are adjustable to permit the distance between delivery plate 22 and guide plates 24 to be varied as needed. FIG. 7 depicts guide plates 24 at an upper position to permit workpieces 12 of a relatively large diameter to be delivered between delivery plate 22 and guide plates 24. FIG. 8 depicts guide plates 24 adjusted to a relatively lower position as compared with that in FIG. 7 to permit workpieces 12 of a relatively smaller outer diameter to be delivered between delivery plate 22 and guide plates 24. It will be appreciated that guide plates 24 are intended to retain workpieces 12 in a single row on delivery plate 22 and to prevent workpieces 12 from stacking one upon another toward the downward end of delivery plate 22. The adjustability of guide plates 24 helps to ensure that workpieces 12 are delivered one at a time to translation system 8 as will be set forth more fully below.

Stopping blocks 26 are each slidably and adjustably mounted to a track 27 that is carried by housings 17. As can be seen in FIGS. 7 and 8, stopping blocks 26 are adjusted along track 27 to ensure that only a single workpiece 12 is fed at any one time to translation system 8, as will be set forth more fully below. Stopping blocks 26 are selectively locked at a desired position along track 27 with a cap screw and T-nut assembly that fits through cooperating holes and channels formed through stopping block 26 and track 27 although virtually any adjustment and locking system can be used without departing from the spirit of the present invention.

Figure 6:
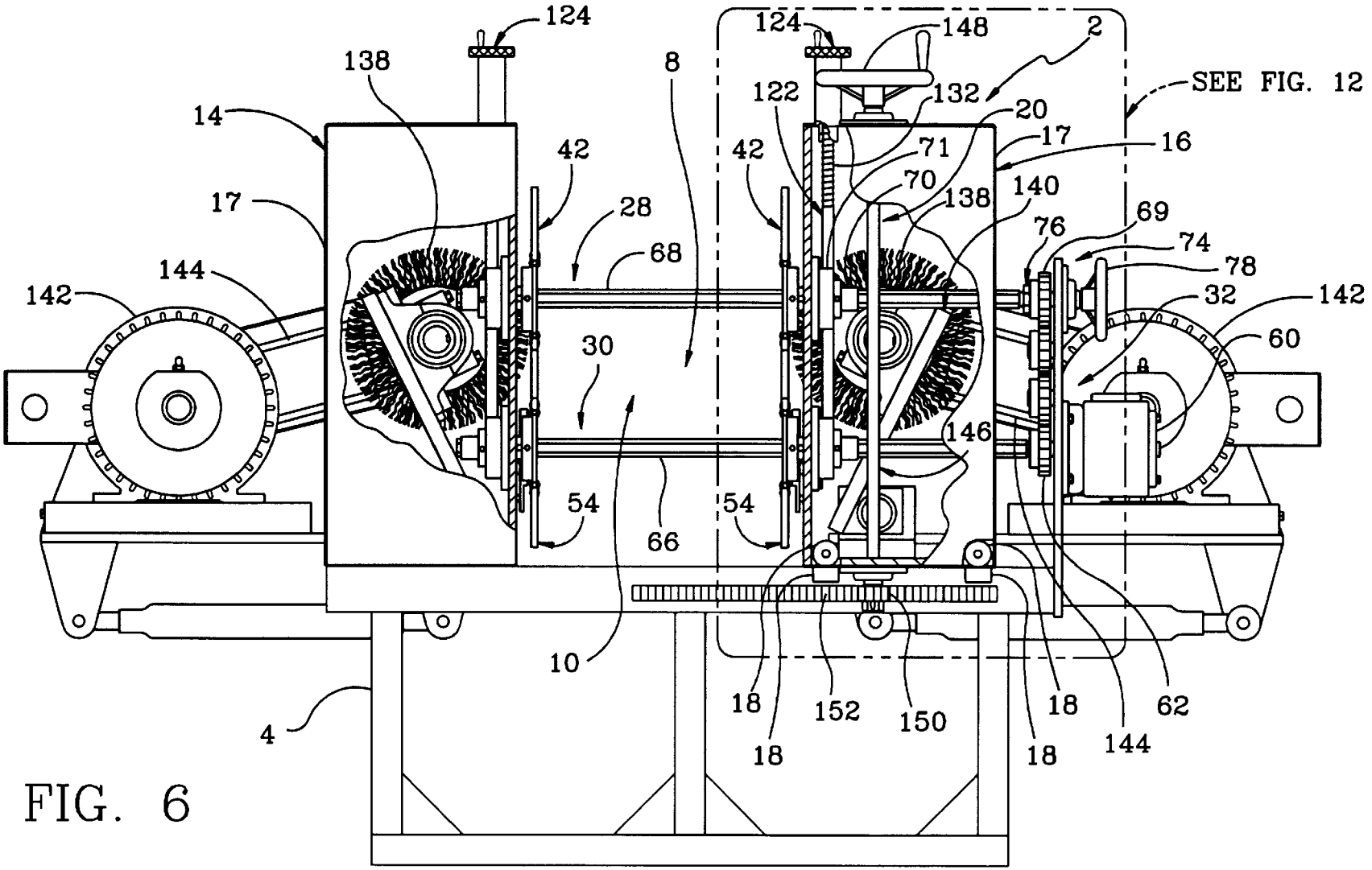
FIG. 6 is a rear elevational view of the present invention shown partially cut away.

Translation system 8 includes an upper conveyor 28 and a lower conveyor 30 that are both driven by a drive assembly 32 (FIG. 6). Translation system 8 additionally includes an adjustable support assembly 34 (FIG. 12) that will be described more fully hereinbelow.

Upper conveyor 28 includes a pair of endless upper chains 36 that are each mounted on an upper drive sprocket 38 and an upper idler sprocket 40. A plurality of upper dogs 42 are mounted by known structures to each upper chain 36 and are spaced apart an equal distance thereon. Upper dogs 42 each contain a first support surface 44 oriented substantially perpendicular to the length of upper chain 36 and a first rear surface 46 that is oblique thereto.

Lower conveyor 30 includes a pair of lower chains 48 that are each mounted on a lower drive sprocket 50 and a lower idler sprocket 52. A plurality of lower dogs 54 are mounted by known structures to each lower chain 48. Each lower dog 54 includes a second support surface 56 disposed substantially perpendicular to the length of lower chain 48 and a second rear surface 58 oblique thereto.

Drive assembly 32 includes a conveyor motor 60 that drives a lowermost gear 62 that is part of a gear train 64 having four gears (FIG. 12). A lower shaft 66 is axially mounted on lowermost gear 62, and an upper shaft 68 is axially mounted on an uppermost gear 69 of gear train 64. Lower and upper shafts 66 and 68 are each elongated shafts having a hexagonal cross section, although other cross sections may be used without departing from the spirit of the present invention. As will be set forth more fully below, a polygonal cross section for lower and upper shafts 66 and 68 is most preferred inasmuch as it facilitates synchronization between upper and lower conveyors 28 and 30. As will be set forth more fully below, one end of upper shaft 68 includes a cylindrical outer surface 79 (FIG. 2) that permits upper conveyor 28 to be adjusted with respect to lower conveyor 30.

Figure 16:
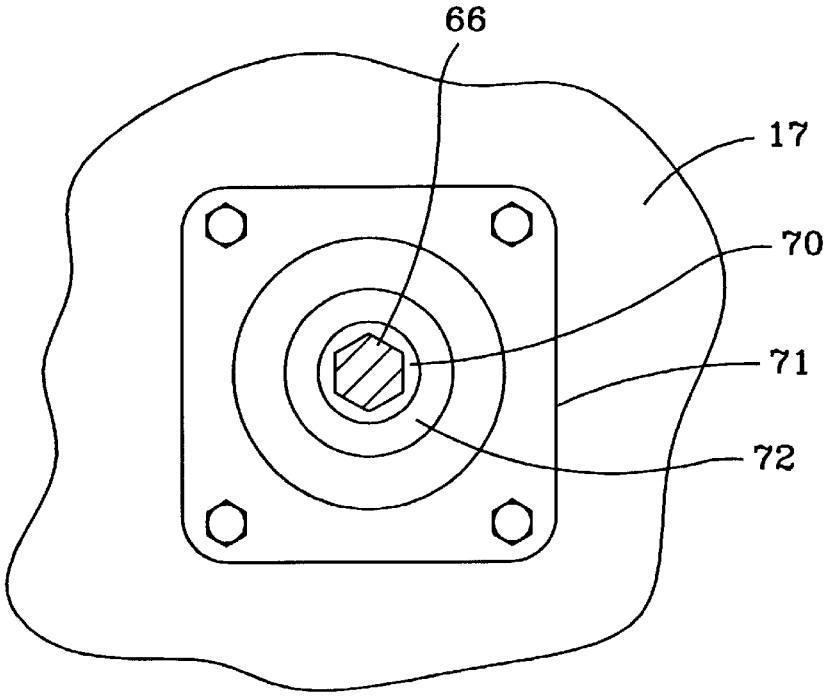
FIG. 16 is a right side elevational view of the components shown in FIG. 15.
Figure 15:
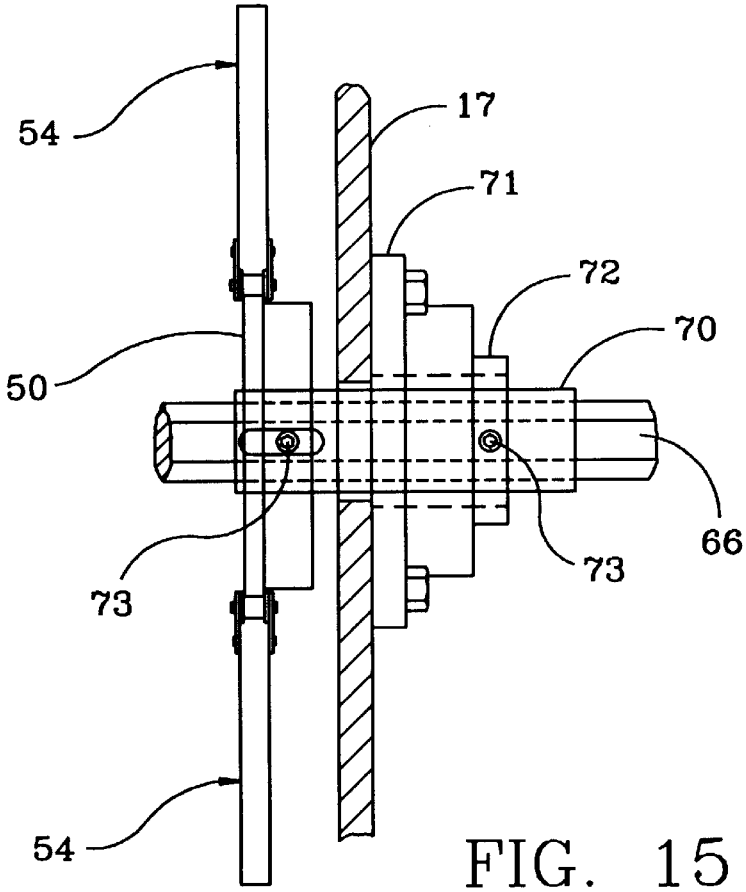
FIG. 15 is an enlarged view of a portion of FIG. 12 surrounded by phantom lines.
Figure 17:
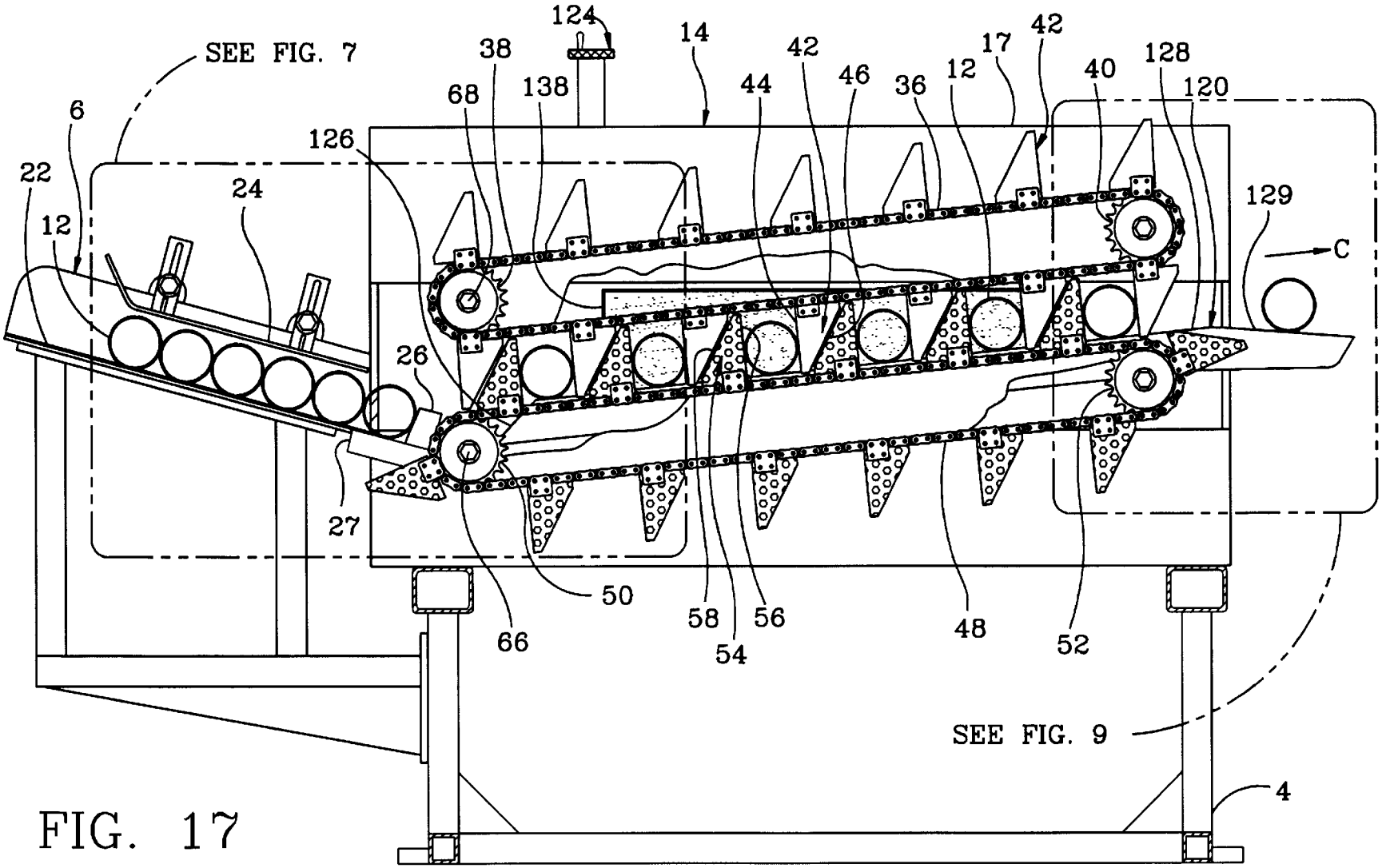
FIG. 17 is a sectional view as taken along line 17—17 of FIG. 1.

As is best shown in FIGS. 4 and 15–16, upper drive sprockets 38 are mounted on upper shaft 68 and lower drive sprockets 50 are mounted on lower shaft 66. Specifically, upper drive sprockets 38 and lower drive sprockets 50 are each mounted on an elongated hex sleeve 70 that has a hexagonal inner surface corresponding with the hexagonal outer surface of upper and lower shafts 68 and 66. In accordance with the features of the present invention, hex sleeves 70 are configured to be slidable along upper and lower shafts 68 and 66. As is best shown in FIG. 15, each hex sleeve 70 is carried by a flange bearing 71 that is fixedly attached to the inner surface of housing 17. Each flange bearing 71 includes an inner race 72 that is securely mounted on the cylindrical outer surface of hex sleeve 70 with a set screw 73. Likewise, upper drive sprockets 38 and lower drive sprockets 50 are each securely mounted on one of hex sleeves 70 with a set screw 73. In accordance with the features of the present invention, therefore, flange bearings 71 rotatably secure hex sleeves 70 to housings 17, yet permit upper and lower shafts 68 and 66 to slide therethrough. Further in accordance with the features of the present invention, inasmuch as upper and lower drive sprockets 38 and 50 are securely mounted to hex sleeves 70, upper and lower drive sprockets 38 and 50 are rotatably mounted on housings 17 and remain in fixed relation thereto despite the sliding of upper and lower shafts 68 and 66 in relation thereto. Upper and lower drive sprockets 38 and 50 thus remain in position with respect to fixed and adjustable heads 14 and 16 despite sliding adjustment of adjustable head 16. Upper and lower idler sprockets 40 and 52 are rotatable mounted to housings 17 by known structures such as roller bearings mounted on posts protruding from housing 17.

In accordance with the features of the present invention, conveyor motor 60 drives gear train 64 thus driving upper and lower shafts 68 and 66 such that upper and lower conveyors 28 and 30 are synchronized with one another. It is understood, therefore, that gear train 64 is configured to cause lower shaft 66 and upper shaft 68 to rotate in opposite directions but with the same angular frequency.

In operation, upper dogs 42 and lower dogs 54 synchronistically achieve a confluence and are in register with one another as they are translated along and interposed between upper and lower chains 36 and 48 in the translation direction as indicated by the arrow C in FIG. 4. Stopping blocks 26 are adjusted to hold the stack of workpieces 12 on delivery plate 22 so as to ensure that only a single workpiece 12 is picked up by one pair of lower dogs 54 as they traverse around lower drive sprockets 50, the adjustment of stopping blocks 26 being based primarily upon the outer diameter of workpieces 12. In accordance with the objectives of the present invention, and as will be set forth more fully below, after workpiece 12 has been lifted from delivery plate 12 and the upper dog pair 42 and the lower dog pair 54 have reached their confluence and are in register with one another and travel in the translation direction as indicated by the arrow C, workpiece 12 is retained between first support surfaces 44 of upper dogs 42 and second support surfaces 56 of a lower dogs 54. Further, in accordance with the objectives of the present invention, and for reasons set forth more fully below, it is preferred that workpieces 12 not be clamped securely between first support surfaces 44 and second support surfaces 56, but rather that a small gap exists therebetween to permit workpiece 12 to rotate axially with respect to first support surfaces 44 and second support surfaces 56 as workpiece 12 is translated through brush system 10.

Figure 2:
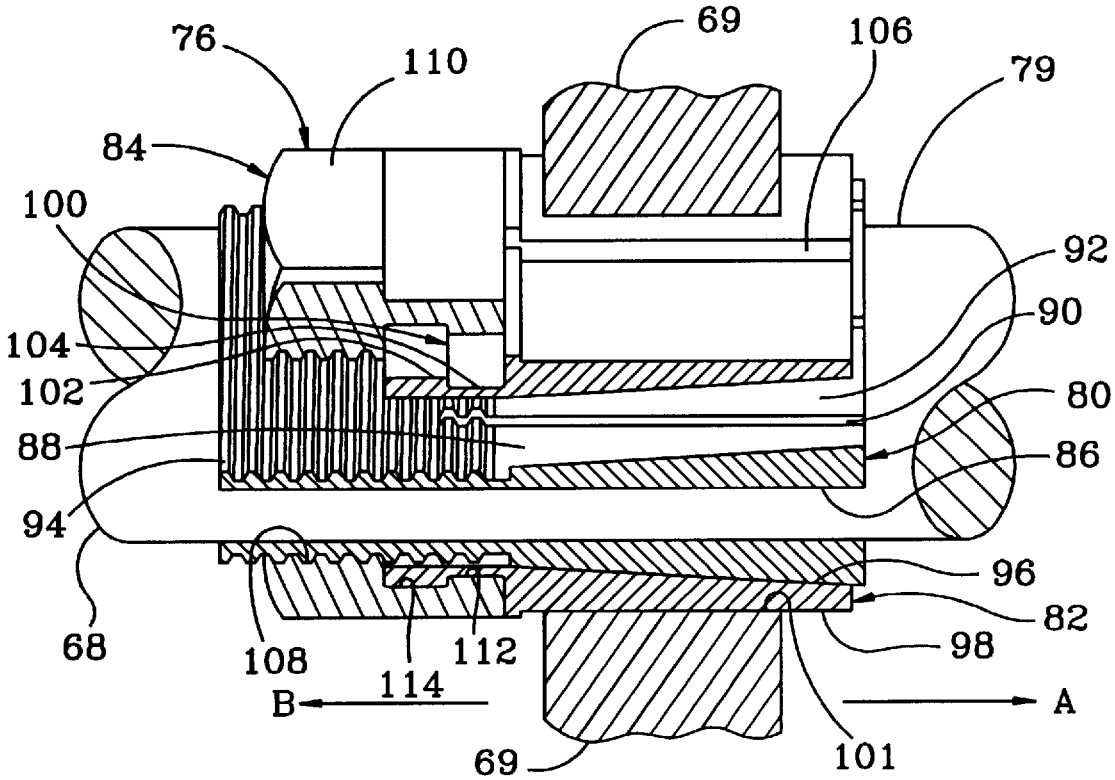
FIG. 2 is an enlarged view, partially in section, of a portion of FIG. 12 encircled by phantom lines.

In accordance with the features of the present invention, the position of upper conveyor 28 with respect to lower conveyor 30 is adjusted with an outer diameter adjustment mechanism 74 that is mounted to upper shaft 68 (FIGS. 2 and 12). Outer diameter adjustment mechanism 74 includes a keyless bushing 76 and an adjustment knob 78. Keyless bushing 76 can be any of a variety of devices known and understood in the relevant art such as the keyless bushing sold under the name Trantorque® manufactured by Fenner Drives of Manhiem, Pa., U.S.A. As is best shown in FIGS. 2 and 12, keyless bushing 76 is mounted on cylindrical outer surface 79 of upper shaft 68. Uppermost gear 69 is, in turn, mounted to keyless bushing 76. As will be set forth more fully below, keyless bushing 76 permits upper shaft 68 to be infinitely adjusted with respect to uppermost gear 69, yet be securely mounted thereto.

As is best shown in FIG. 2, and as is understood in the relevant art, keyless bushing 76 includes an inner sleeve 80, an outer sleeve 82, and a nut 84. Inner sleeve 80 includes an inner surface 86, an outer surface 88 opposed thereto, and a plurality of relief cutouts 90. Inner surface 86 lies directly against cylindrical outer surface 79 of upper shaft 68. Outer surface 88 includes a tapered surface 92 and a threaded portion 94.

Outer sleeve 82 includes a tapered surface 96, a gear mounting surface 98 opposed thereto, and a skirt 100. Tapered surface 96 lies directly against and is configured to have a cooperative opposite taper of tapered surface 92 of inner sleeve 80 to permit tapered surfaces 92 and 96 to slidably interact with one another, as will be set forth more fully below. Gear mounting surface 98 carries uppermost gear 69 directly thereon. Uppermost gear 69 is formed with an axially disposed mounting bore 101 that is carried directly on gear mounting surface 98. Skirt 100 is formed with a ridge 102 and a channel 104 extending circumferentially about the outer face thereof. Outer sleeve 82 is additionally formed with an assembly cutout 106 that allows outer sleeve 82 to be compressed sufficiently to permit nut 84 to be operationally mounted on skirt 100.

Nut 84 includes an inner threaded surface 108 facing inwardly, a plurality of flats 110 opposed thereto, a ridge 112, and a channel 114. Inner threaded surface 108 cooperates threadably with threaded portion 94 of inner sleeve 80, and ridge 112 and channel 114 slidably cooperate with channel 104 and ridge 102, respectively, of outer sleeve 82. Flats 110 are configured to permit a wrench or other tool to be applied thereto for the purpose of axially rotating nut 84.

With keyless bushing 76 assembled onto cylindrical outer surface 79 as shown in FIG. 2, rotation of nut 84 in a direction causing outer sleeve 82 to move in the direction of arrow A with respect to inner sleeve 80 causes tapered surfaces 92 and 96 to slidably interact, and thus causing gear mounting surface 98 of outer sleeve 82 to extend in the outward direction against mounting bore 101 of uppermost gear 69. As is understood in the relevant art, therefore, the movement of nut 84 in the direction of arrow A causes keyless bushing 76 to be tightly compressed between mounting bore 101 and cylindrical outer surface 79, thus causing uppermost gear 69 to be tightly mounted on upper shaft 68. Likewise, the rotation of nut 84 in the opposite direction, i.e., to cause outer sleeve 82 to move in the direction of arrow B with respect to inner sleeve 80, causes tapered surfaces 92 and 96 to slide away from one another, thus reducing the compression between mounting bore 101 and cylindrical outer surface 79. As such, the movement of nut 84 in the direction of arrow B releases uppermost gear 69 from its tight mounting on upper shaft 68 and permits the rotational position of upper shaft 68 to be adjusted with respect to the rotational position of uppermost gear 69 without disassembling drive assembly 32 further than loosening nut 84. Inasmuch as upper drive sprockets 38 of upper conveyor 28 are mounted on upper shaft 68, adjustment of upper shaft 68 with respect to gear train 64 thus permits upper dogs 42 to be adjusted with respect to lower dogs 54. Adjustment knob 78 is mounted on the end of cylindrical outer surface 79 and is used to adjust the rotational position of upper shaft 68 as needed. Relief cutouts 90 formed in inner sleeve 80 facilitate the compression and decompression between inner and outer sleeves 80 and 82 by allowing inner sleeve 80 to be tightly compressed inwardly against cylindrical outer surface 79 without plastic deformation.

In operation, therefore, uppermost gear 69 is tightly mounted on upper shaft 68 with the assistance of keyless bushing 76, thus fixing the distance between first support surface 44 and second support surface 56 as upper and lower dogs 42 and 54 are translated in synchronized confluence and in register with one another. The distance between first support surface 44 and second support surface 56 is adjusted by stopping drive assembly 32 and loosening nut 84 of keyless bushing 76 to cause outer sleeve 82 to move in the direction of arrow B with respect to inner sleeve 80, thus causing tapered surfaces 92 and 96 to slide away from each other, and thus reducing the compressive force between mounting bore 101 and cylindrical outer surface 79. Adjustment knob 78 is then rotated to cause upper shaft 68 to rotate and to cause upper conveyor 28 to move until the desired distance between first support surfaces 44 and second support surfaces 56 of upper and lower dogs 42 and 54 is achieved. Nut 84 is then retightened, causing tapered surfaces 92 and 96 to slidably and compressively interact, and thus causing uppermost gear 69 to be tightly affixed to upper shaft 68. In such adjusted position, upper and lower conveyors 28 and 30 still operate synchronistically when conveyor motor 60 is restarted inasmuch as the gears of gear train 64 have not themselves been adjusted and only the rotational position of upper shaft 68 has been adjusted with respect to the rotational position of uppermost gear 69. In accordance with the features of the present invention, therefore, the distance between first and second support surfaces 44 and 56 can be adjusted without affecting the synchronization of upper and lower conveyors 28 and 30 and without requiring disassembly of gear train 64.

Figure 11:
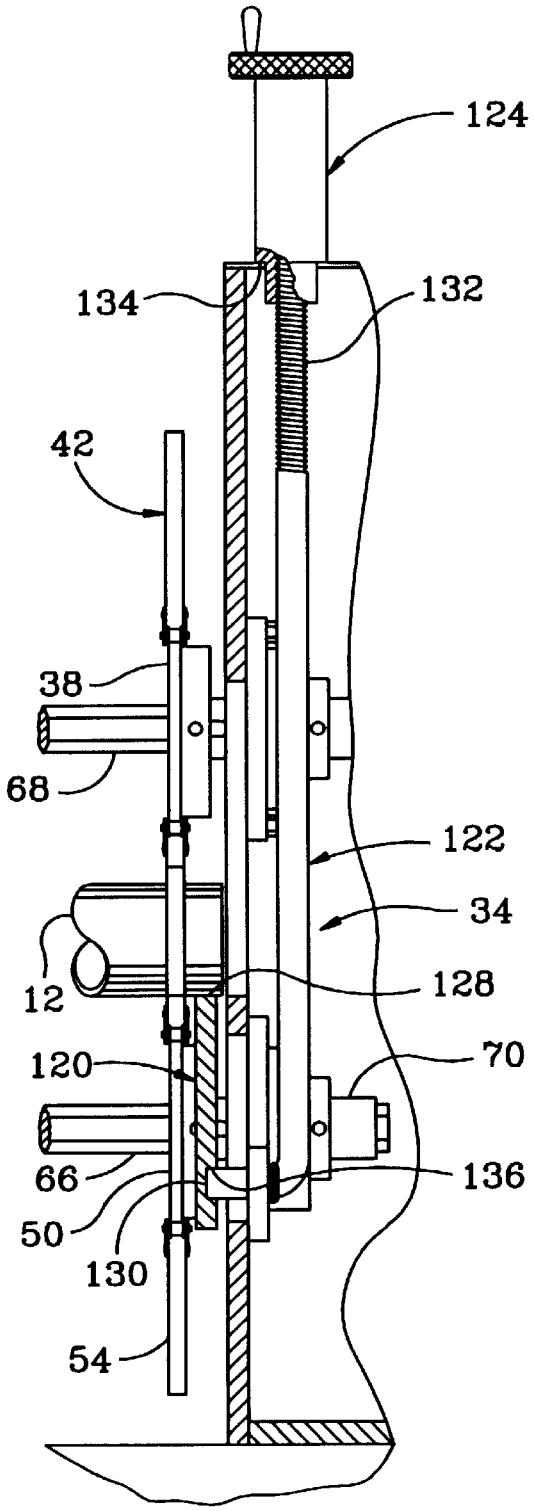
FIG. 11 is a sectional view as taken along line 11—11 of FIG. 1.
Figure 14:
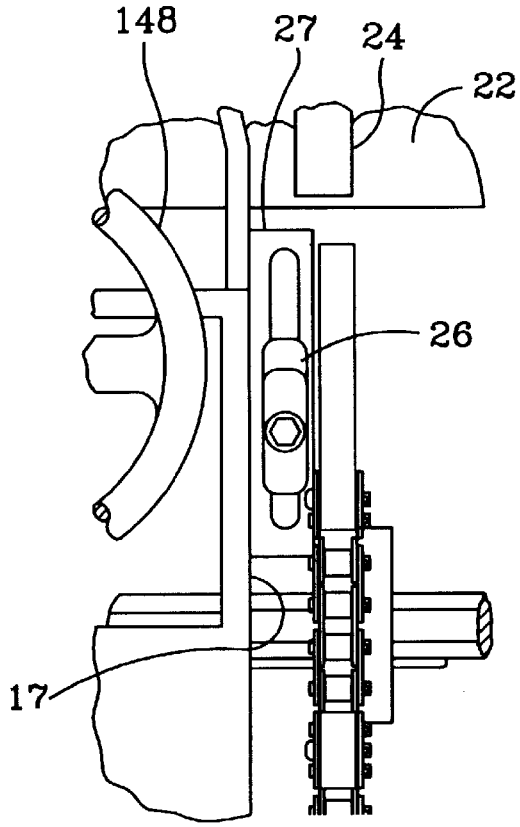
FIG. 14 is an enlarged view of the portion of FIG. 1 surrounded by phantom lines.

Support assembly 34 supports workpieces 12 and causes them to travel along an adjustable inclined path as they are retained between first and second support surfaces 44 and 56 and are translated through brush system 10. Support assembly 34 (FIGS. 1 and 11) includes a pair of support rails 120, a pair of adjustment rods 122, and a pair of adjustment knobs 124. Support rails 120 each include an input end 126 adjacent feed system 6 and an output end 129 at the opposite end. A third support surface 128 is defined along the top of each support rail 120 between input and output ends 126 and 129. Each adjustment rod 122 is an elongated member having a tip 130 extending at a right angle to the length of adjustment rod 122 and includes a plurality of external threads 132 formed thereon at the end opposite tip 130. Adjustment knob 124 includes a plurality of internal threads that cooperate threadably with external threads 132 of adjustment rod 122 and a lower surface 134 that rests against housing 17.

Identical support rails 120, adjustment rods 122, and adjustment knobs 124 are mounted to each of fixed and adjustable heads 14 and 16. Tip 130 of adjustment rod 122 fits inside a hole 136 formed in support rail 120 in the vicinity of input end 126. Rotational adjustment of adjustment knob 124 causes adjustment rod 122 to be threadably raised and lowered with respect to adjustment knob 124, thus causing input end 126 to correspondingly be selectively raised and lowered upon rotation of adjustment knob 124.

Output ends 129 of support rails 120 are each rotatably mounted to housings 17 on the shaft of a bolt 137 (FIG. 12) protruding from housing 17. As such, support rail 120 pivots about bolt 137 with input end 126 selectively being adjusted upward and downward to ensure that workpieces 12 are fully deburred as they pass through brush system 10.

Figure 3:
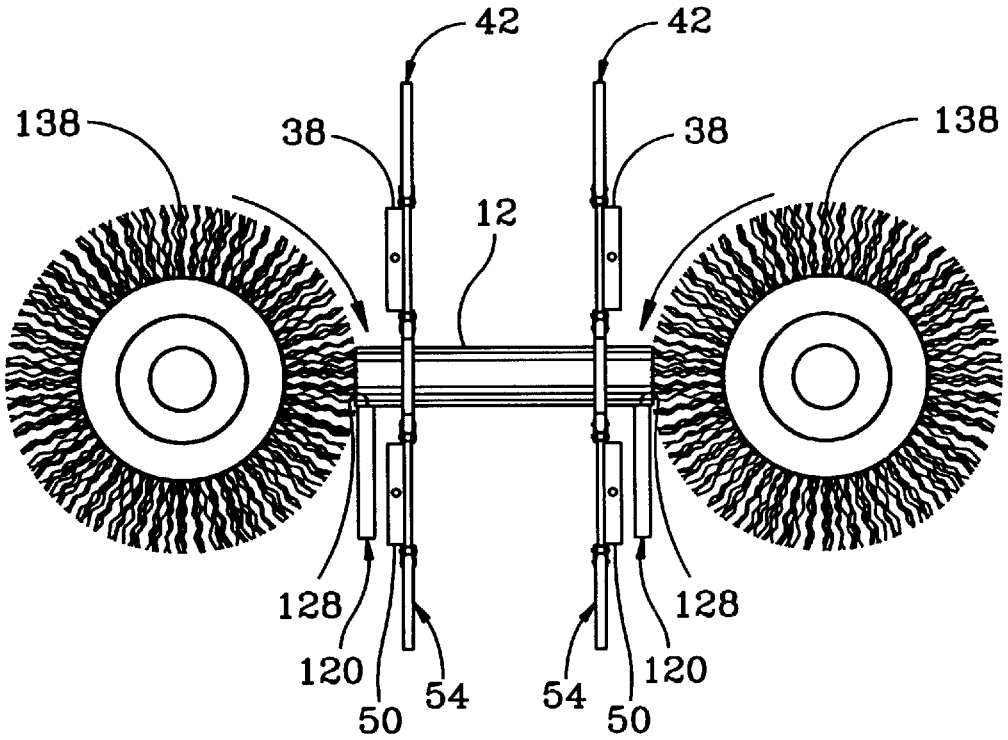
FIG. 3 is a sectional view as taken along line 3—3 of FIG. 1.

Brush system 10 includes a pair of cylindrical wire brushes 138, each mounted with a brush mounting assembly 140, and each mounted inside housing 17 of fixed and adjustable heads 14 and 16. Wire brushes 138 are each driven by a brushmotor 142 connected to wire brush 138 with a belt 144 (FIG. 6). Brush mounting assemblies 140 each include known structures such as bearings, bushings, shafts, and the like. The axis of wire brushes 138 are parallel and spaced apart and are disposed on alternate sides of translation system 8. Wire brushes 138 protrude slightly from housings 17 in the vicinity of upper and lower conveyors 28 and 30 such that wire brushes 138 contact the cut ends of workpieces 12 as they are translated therebetween by translation system 8. As is best shown in FIG. 3, wire brushes 138 rotate in opposite directions such that the brushing action of wire brushes 138 on workpieces 12 imparts a generally downward force to workpieces 12.

As indicated hereinbefore, adjustable head 16 is selectively positioned on frame 4 by adjustment of length adjustment assembly 20. Length adjustment assembly 20 includes an adjustment shaft 146 (FIG. 6) rotatably mounted on adjustable head 16 and that contains an adjustment knob 148 at one end and a pinion 150 at the other end. Pinion 150 operatively engages a rack 152 disposed on frame 4. Rotation of adjustment knob 148 rotates adjustment shaft 146 and causes pinion 150 to move along rack 152, thus correspondingly moving adjustable head 16 therewith.

Deburring machine 2 is operationally set up according to the length and outer diameter of workpieces 12. Adjustment knob 148 of length adjustment assembly 20 is adjusted until wire brushes 138 are spaced sufficiently away from workpieces 12 to ensure contact between wire brushes 138 and the ends of workpieces 12. Inasmuch as upper and lower drive sprockets 38 and 50 are rotatably mounted on housings 17 with the assistance of hex sleeves 70, upper and lower drive sprockets 38 and 50 translate with adjustable head 16 when adjustable head 16 is slidably adjusted with length adjustment 20 inasmuch as upper and lower shafts 68 and 66 slide through hex sleeves 70 without resistance. Wire brushes 138 are preferably adjusted no closer than necessary to workpieces 12 to limit unnecessary wear and tear on wire brushes 138.

Stopping blocks 26 are adjusted along tracks 27 to hold workpieces 12 sufficiently back along delivery plate 22 to ensure that only a single workpiece 12 is picked up by the corresponding pairs of lower dogs 54 as they pass delivery plate 22 while rotating about lower drive sprockets 50.

Upper conveyor 28 is then adjusted to accommodate workpieces 12 between first and second support surfaces 44 and 56. In accordance with the features of the present invention, wire brushes 138 operationally apply a downward force on workpieces 12, thus holding workpieces 12 against third support surface 128 of support rail 120 when wire brushes 138 are rotated by brushmotors 142. The downward force imparted by wire brushes 138 on workpieces 12 in combination with the translation of workpieces 12 by translation system 8 cause workpieces 12 to roll along third support surface 128 with workpiece 12 rotating axially with respect to first and second support surfaces 44 and 56.

To ensure that workpiece 12 is permitted to rotate in the aforementioned manner, upper conveyor is adjusted with respect to lower conveyor 30 according to the outer diameter of workpiece 12. Specifically, upper conveyor 28 is adjusted such that at least a nominal space exists between each workpiece 12 and first and second support surfaces 44 and 56. It is preferred that the clearance provided between workpiece 12 and first and second support surfaces 44 and 56 be in the range of approximately one-sixteenth to three-sixteenth inches, although other clearances larger and smaller may be appropriate based upon the outer diameter and length of workpiece 12.

It is preferred that workpiece 12 be axially rotated as it passes through brush system 10 to ensure the removal of all of the burrs from the ends of workpiece 12 in the prescribed manner. In this regard, support assembly 34 is adjusted to maximize the exposure of wire brushes 138 to the ends of workpieces 12 as workpieces 12 are translated from input end 126 of support rail 120 to output end 129 thereof. Adjustment knob 148 is thus rotated until the uppermost edge of workpiece 12 is disposed beneath an imaginary plane containing the axis of wire brushes 138 when workpiece 12 initially comes into contact with wire brushes 138 as workpiece 12 rolls along third support surface 128 of support rail 120. The vertical adjustment of support rail 120 can, however, be varied from this without departing from the spirit of the present invention.

Workpieces 12 are thus retained between first and second support surfaces 44 and 56 while being translated between wire brushes 138. In accordance with the features of the present invention, the retention of workpieces 12 between first and second support surfaces 44 and 56 in the manner set forth above prevents workpieces 12 from becoming unstable and shifting diagonally, and still permits workpieces 12 to roll along third support surface 128 of support rail 120, thus permitting burrs to be removed from the entire circumference of the ends of workpieces 12. Further in accordance with the features of the present invention, the retention of workpieces 12 between first and second support surfaces 44 and 56 permits shorter lengths of tubing to be deburred than was previously known in the relevant art. Deburring machine 2 is configured to permit lengths of tubing as short as three inches to be deburred in the manner prescribed herein, but the teachings of the present invention indicate that lengths far shorter than three inches can be deburred by appropriately configuring the arrangement of feed system 6, translation system 8, and brush system 10.

Still further in accordance with the features of the present invention, deburring machine 2 can be readily adjusted to remove burrs from other workpieces having different lengths and/or different outer diameters. Keyless bushing 76 permits workpieces 12 of differing diameters to be retained between first and second support surfaces 44 and 56 in the manner prescribed herein, yet does not interfere with the synchronization of upper and lower conveyors 28 and 30 or the synchronized confluence of upper and lower dogs 42 and 54.

As can be seen in FIGS. 7 and 8, upper and lower conveyors 28 and 30 are configured to retain workpieces 12 having an outer diameter in approximately the range of one-half to three inches between first and second support surfaces 44 and 56. It is understood from the foregoing that upper and lower dogs 42 and 54 and/or upper and lower conveyors 28 and 30 can be reconfigured to accommodate workpieces 12 of nearly any diameter and length without departing from the spirit of the present invention. The infinite adjustability of upper conveyor 28 between a minimum position where workpieces of the minimum outer diameter are retained and a maximum position where workpieces of the maximum outer diameter are retained permits the distance between first and second support surfaces 44 and 56 to be finely adjusted as needed to ensure that workpieces 12 can roll along third support surface 128 of support rail 120 and rotate with respect to first and second support surfaces 44 and 56, yet be fully deburred as it is translated between wire brushes 138.

Accordingly, the improved deburring machine apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the deburring machine is constructed and used, the characteristics of the construction, and the advantageous new and useful results obtained; the new and useful structures, devices, elements, arrangements, parts, and combinations are set forth in the appended Claims.

I claim:

1. A machine for removing burrs from a workpiece having a pair of ends, the burrs disposed on the ends of the workpiece, said machine comprising:

a frame;

a first support surface and a second support surface mounted on said frame;

a brush system;

said first and second support surfaces included respectively on spaced first and second conveyor means so that said first and second support surfaces are translatable with respect to said brush system; and said first and second support surfaces configured to retain the workpiece therebetween, the workpiece being free to rotate with respect to said first and second support surfaces as the workpiece operationally interacts with said brush system.

2. The machine as set forth in claim 1 wherein said first conveyor means is mounted on at least a first shaft and said second conveyor means is mounted on at least a second shaft spaced at a distance from said first shaft and said distance between said first and second shafts is adjustable by an adjustable support means.

3. The machine as set forth in claim 1, further comprising a support assembly mounted on said frame, a third support surface being defined on said support assembly, said third support surface cooperating with said first and second support surfaces to retain the workpiece therebetween.

4. The machine as set forth in claim 3, wherein said first support surface includes a pair of spaced first support surfaces, wherein said second support surface includes a pair of spaced second support surfaces, and wherein said third support surface includes a pair of spaced third support surfaces defined on said support assembly, one of said first support surfaces, one of said second support surfaces, and one of said third support surfaces cooperating to retain one end of the workpiece therebetween, the other of said first support surfaces, the other of said second support surfaces, and the other of said third support surfaces cooperating to retain the other end of the workpiece therebetween.

5. A machine for removing burrs from a workpiece having a pair of ends, the burrs disposed on the ends of the workpiece, said machine comprising:

a frame;

a first support surface and a second support surface mounted on said frame;

a brush system;

said first and second support surfaces translatable with respect to said brush system;

said first and second support surfaces configured to retain the workpiece therebetween, the workpiece being free to rotate with respect to said first and second support surfaces as the workpiece operationally interacts with said brush system; and an upper conveyor and a lower conveyor for translating said first and second support surfaces with respect to said brush system.

6. The machine as set forth in claim 5 wherein said first support surface is defined on said upper conveyer and said second support surface is defined on said lower conveyor.

7. The machine as set forth in claim 6 wherein said upper and lower conveyors are respectively mounted on first and second shafts and said first and second shafts are interconnected by a gear train, whereby said upper and lower conveyors are operationally synchronized.

8. The machine as set forth in claim 7, wherein said first shaft is spaced from said second shaft by a vertical distance and said vertical distance is selectively adjustable by an adjustable support means.

9. The machine as set forth in claim 8, further comprising a drive assembly, said upper and lower conveyor being operationally mounted on said drive assembly.

10. The machine as set forth in claim 9 further comprising a keyless bushing, said keyless bushing mounted on said drive assembly, said keyless bushing being operationally disposed between said drive assembly and said upper conveyor.

11. The machine as set forth in claim 10 wherein said drive assembly comprises a gear train including at least an uppermost gear and a lowermost gear, an upper shaft mounted on said uppermost gear, and a lower shaft mounted on said lowermost gear, a pair of upper chains being mounted on said upper shaft, a pair of lower chains being mounted on said lower shaft.

12. The machine as set forth in claim 11 wherein said keyless bushing is mounted on said upper shaft and said uppermost gear is mounted on said keyless bushing.

13. The machine as set forth in claim 10 wherein said upper conveyor includes at least a first upper chain and wherein said lower conveyor includes at least a first lower chain, said first support surface defined on said at least first upper chain and said second support surface defined on said at least first lower chain.

14. The machine as set forth in claim 13 wherein said upper conveyor further includes at least a first upper dog mounted thereon, said first support surface defined on said at least first upper dog, and wherein said lower conveyor further includes at least a first lower dog, said second support surface defined on said at least first lower dog.

15. The machine as set forth in claim 5 wherein said brush system includes at least a first brush rotatably mounted on said frame.

16. The machine as set forth in claim 15 wherein said brush system further comprises a second brush rotatably mounted on said frame.

17. The machine as set forth in claim 15, further comprising a fixed head mounted on said frame and an adjustable head adjustably mounted on said frame, one of said first and second brushes rotatably mounted on said fixed head, the other of said first and second brushes rotatably mounted on said adjustable head.

18. The machine as set forth in claim 17 wherein said upper conveyor further includes a pair of upper chains and wherein said lower conveyor further includes a pair of lower chains, one of said upper chains mounted on said fixed head, one of said lower chains mounted on said fixed head, the other of said upper chains mounted on said adjustable head, the other of said lower chains mounted on said adjustable head, said first support surface defined on said upper chains, said second support surface defined on said lower chains.

19. The machine as set forth in claim 18 wherein said upper chains each include at least a first upper dog and wherein said lower chains each include at least a first lower dog, said first support surface defined on said at least first upper dogs, said second support surface defined on said at least first lower dogs.

20. A method for removing burrs from a workpiece comprising the steps of:

translating the workpiece with a translation system comprising spaced first and second conveyor means having respectively first and second support surfaces through a brush system where brushes contact both ends of the workpiece;

retaining the workpiece between the first and second support surfaces; and rotating the workpiece with respect to the first and second support surfaces.

21. The method as set forth in claim 20 wherein said retaining step includes the step of retaining the workpiece between the first and second support surfaces and a third support surface defined on the translation system.

22. The method as set forth in claim 21 wherein said retaining step includes the step of retaining the workpiece between two sets of first, second, and third support surfaces defined on the translation system.

23. The method of claim 20 wherein the first and second conveyors are respectively upper and lower conveyors.

24. The method as set forth in claim 23 wherein said first support surface is defined on said upper conveyor and said second support surface is defined on said lower conveyor.

25. The method as set forth in claim 24 wherein said upper and lower conveyors are respectively mounted on first and second shafts and said first and second shafts are interconnected by a gear train so that said upper and lower conveyors are operationally synchronized.

26. The method as set forth in claim 25 wherein said first shaft is spaced from said second shaft by a vertical distance and said vertical distance is selectively adjustable by an adjustable support means.

27. The method as set forth in claim 26 further comprising a drive assembly, said upper and lower conveyor being operationally mounted on said drive assembly.

28. The method as set forth in claim 27 further comprising a keyless bushing, said keyless bushing mounted on said drive assembly, said keyless bushing being operationally disposed between said drive assembly and said upper conveyor.

29. The method as set forth in claim 28 wherein said drive assembly comprises a gear train including at least an uppermost gear and a lowermost gear, an upper shaft mounted on said uppermost gear, and a lower shaft mounted on said lowermost gear, a pair of upper chains being mounted on said upper shaft, and a pair of lower chains being mounted on said lower shaft.

30. The method as set forth in claim 29 wherein said keyless bushing is mounted on said upper shaft and said uppermost gear is mounted on said keyless bushing.

31. The method as set forth in claim 28 wherein said upper conveyor includes at least a first upper chain and wherein said lower conveyor includes at least a first lower chain, said first support surface defined on said at least first upper chain and said second support surface defined on said at least first lower chain.

32. The method as set forth in claim 31 wherein said upper conveyor further includes at least a first upper dog mounted thereon, said first support surface defined on said at least first upper dog, and wherein said lower conveyor further includes at least a first lower dog, said second support surface defined on said at least first lower dog.

33. The method as set forth in claim 20 wherein the translation system and the brush system are mounted on a frame, and a third support surface is defined on said support assembly and said third support surface cooperates with said first and second support surfaces to retain the workpiece therebetween.

34. The method as set forth in claim 33 wherein said first support surface includes a pair of spaced first support surfaces, wherein said second support surface includes a pair of spaced second support surfaces, and wherein said third support surface includes a pair of spaced third support surfaces, one of said second support surfaces, and one of said third support surfaces cooperating to retain one end of the workpiece therebetween, the other of said first support surfaces, the other of said second support surfaces, and the other of said third support surfaces cooperating to retain the other end of the workpiece therebetween.

* * * * *